US011325394B2

(12) United States Patent
Lavie et al.

(10) Patent No.: US 11,325,394 B2
(45) Date of Patent: May 10, 2022

(54) APPARATUS AND METHOD FOR PRESSURE REGULATION

(71) Applicant: Stratasys Ltd., Rehovot (IL)

(72) Inventors: Gil Lavie, Ness Ziona (IL); Moshe Levi, Tel-Aviv (IL)

(73) Assignee: STRATASYS LTD., Rehovot (IL)

( * ) Notice: Subject to any disclaimer, the term of this patent is extended or adjusted under 35 U.S.C. 154(b) by 315 days.

(21) Appl. No.: 15/477,660

(22) Filed: Apr. 3, 2017

(65) Prior Publication Data

US 2017/0266980 A1 Sep. 21, 2017

Related U.S. Application Data

(63) Continuation of application No. 13/342,212, filed on Jan. 3, 2012, now abandoned.

(51) Int. Cl.
*B41J 2/175* (2006.01)

(52) U.S. Cl.
CPC ..... *B41J 2/17596* (2013.01); *B41J 2/175* (2013.01); *B41J 2/17506* (2013.01); *Y10T 137/0396* (2015.04); *Y10T 137/85978* (2015.04)

(58) Field of Classification Search
CPC ..... F04B 49/022; F04B 49/06; F04B 49/08; F04B 49/12; F04B 49/20; F04B 43/00; F04B 45/08; F04B 2207/02; F04B 2205/07; B41J 2/175; B41J 2/17506; B41J 2/17596; Y10T 137/0396; Y10T 137/85978
USPC ..... 417/14, 19, 38, 44.2, 44.3, 53, 474–475, 417/477; 347/6, 17
See application file for complete search history.

(56) References Cited

U.S. PATENT DOCUMENTS

| | | | |
|---|---|---|---|
| 4,575,735 | A | 3/1986 | Weinberg |
| 5,227,049 | A | 7/1993 | Chevallet et al. |
| 5,418,557 | A | 5/1995 | Pullen |
| 5,665,061 | A | 9/1997 | Antwiler |
| 6,203,146 | B1 | 3/2001 | Pawlowksi et al. |
| 6,224,198 | B1 | 5/2001 | Cook et al. |
| 6,243,115 | B1 | 6/2001 | Baker et al. |

(Continued)

FOREIGN PATENT DOCUMENTS

| | | |
|---|---|---|
| EP | 1 698470 | 9/2006 |

*Primary Examiner* — Dominick L Plakkoottam
*Assistant Examiner* — Charles W Nichols
(74) *Attorney, Agent, or Firm* — Pearl Cohen Zedek Latzer Baratz LLP

(57) ABSTRACT

A system for maintaining a desired pressure difference between a first pressure within a chamber and a reference pressure at a reference space. The system may include a peristaltic pump located along a duct that connects the chamber with the reference space. The system may further include a pressure sensor for monitoring an actual pressure difference between the first pressure within the chamber and the reference pressure at the reference space. The system may also include a controller for receiving a signal from the pressure sensor for determining the actual pressure difference from the pressure sensor and for operating the peristaltic pump, in accordance with the actual pressure difference and the desired pressure difference, to increase, decrease or leave unchanged the pressure within the chamber so as to maintain the actual pressure difference within predetermined proximity to the desired pressure difference.

4 Claims, 2 Drawing Sheets

(56) References Cited

U.S. PATENT DOCUMENTS

| | | | | |
|---|---|---|---|---|
| 6,698,869 | B2 * | 3/2004 | Vosahlo | B41J 2/175 347/7 |
| 7,658,976 | B2 | 2/2010 | Kritchman | |
| 7,717,540 | B1 * | 5/2010 | King | B41J 2/165 347/34 |
| 7,725,209 | B2 | 5/2010 | Menchick et al. | |
| 7,866,960 | B2 * | 1/2011 | Parng | F04B 43/12 417/474 |
| 7,991,498 | B2 | 8/2011 | Kritchman | |
| 9,073,333 | B2 | 7/2015 | Campbell | |
| 2004/0070641 | A1 | 4/2004 | Inoue | |
| 2005/0019185 | A1 * | 1/2005 | Otis | F04B 43/1253 417/475 |
| 2005/0185033 | A1 | 8/2005 | Miki | |
| 2006/0209115 | A1 | 9/2006 | Espasa et al. | |
| 2008/0192095 | A1 | 8/2008 | Kojima | |
| 2008/0227663 | A1 | 8/2008 | Tisone et al. | |
| 2009/0179974 | A1 | 7/2009 | Kimura | |
| 2010/0079559 | A1 | 4/2010 | Justice et al. | |
| 2010/0079567 | A1 * | 4/2010 | Akatsuka | B41J 2/17509 347/92 |
| 2010/0295908 | A1 | 11/2010 | Katoh et al. | |

* cited by examiner

APPARATUS AND METHOD FOR PRESSURE REGULATION

CROSS REFERENCE TO RELATED APPLICATIONS

This application is a Continuation Application of U.S. patent application Ser. No. 13/342,212, filed on Jan. 3, 2012, which is incorporated in its entirety herein.

FIELD OF THE INVENTION

The present invention relates to apparatus and methods for pressure regulation.

BACKGROUND

Inkjet printing heads dispense droplets of ink or other fluid material (for example liquids, suspensions, gels) via nozzles. The material to be dispensed is selectively discharged from an inkjet printing head nozzle or plurality of nozzles when an electric pulse is directed to the respective nozzle or nozzles. To prevent gravitational leakage, the printing head is maintained under a moderate sub-atmospheric pressure (vacuum) compared to the surrounding atmosphere, which is sufficient to keep the material from gravitationally dripping out of the nozzles.

The sub-atmospheric pressure needs to be continuously and precisely maintained within a predefined narrow range, because insufficient vacuum may lead to leakage while excessive vacuum might interfere with the operation of the discharge mechanism. The desired vacuum may depend on the design of the printing head, the specific gravity of the material being dispensed, and the height of the material above the nozzle level. An exemplary representative value of the sub-atmospheric pressure employed may be about −60 mm water pressure.

When material is dispensed from the printing head, the vacuum within the reservoir of material feeding the head increases, whereas when material is fed into the reservoir, the vacuum drops. For maintaining the vacuum at the desired level, a vacuum pump is customarily used to draw air out of the reservoir to reduce the pressure within, whereas a leak orifice inlet allows air to flow into the reservoir when the pressure inside the reservoir of material is too low. The electrical power supplied to the pump is controlled so as to ensure that a desired vacuum level is maintained.

Sub-atmospheric pressure is applied to prevent leakage, even when the printing device is inoperative. The mechanism described above for maintaining the vacuum thus requires uninterrupted operation of the vacuum pump at all times, which consumes energy and reduces the effective life of the pump.

SUMMARY OF THE INVENTION

There is thus provided, in accordance with embodiments of the present invention, a system for maintaining a desired pressure difference between a first pressure within a chamber and a reference pressure at a reference space. The system may include a peristaltic pump located along a duct that connects the chamber with the reference space. The system may further include a pressure sensor for monitoring an actual pressure difference between the first pressure within the chamber and the reference pressure at the reference space. The system may also include a controller for receiving a signal from the pressure sensor for determining the actual pressure difference from the pressure sensor and for operating the peristaltic pump, in accordance with the actual pressure difference and the desired pressure difference, to increase, decrease or leave unchanged the pressure within the chamber so as to maintain the actual pressure difference within predetermined proximity to the desired pressure difference.

In some embodiments of the present invention the reference space may be ambient atmosphere.

In some embodiments of the present invention the chamber forms part of a printing block of a printer.

In accordance with embodiments of the present invention the chamber may be within a material reservoir of the printing block.

In some embodiments of the present invention the controller may be designed to cause the peristaltic pump to operate when the measured pressure difference exceeds a predetermined pressure difference range.

In some embodiments of the present invention the predetermined pressure difference range may be a modifiable parameter of the system.

In accordance with some embodiments of the present invention there is provided a method for maintaining a desired pressure difference between a first pressure within a chamber and a reference pressure at a reference space. The method may include providing a peristaltic pump located along a duct that connects the chamber with the reference space and a controller. The method may also include monitoring an actual pressure difference between the first pressure within the chamber and the reference pressure at the reference space using a pressure sensor. The method may further include using the controller, receiving a signal from the pressure sensor for determining the actual pressure difference from the pressure sensor and operating the peristaltic pump, in accordance with the actual pressure difference and the desired pressure difference, to increase, decrease or leave unchanged the pressure within the chamber so as to maintain the actual pressure difference within predetermined proximity to the desired pressure difference.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

DETAILED DESCRIPTION OF EMBODIMENTS OF THE INVENTION

According to embodiments of the present invention, an inkjet printer may be equipped with one or more printing heads. Each of the printing heads may include or be connected via valves or other means to a container, e.g. reservoir containing the fluid material to be dispensed and one or more print nozzles for dispensing the material upon electric actuation. One or more pressure sensors may be provided for sensing the relative pressure above the liquid material level, e.g. air in the reservoir, above the liquid level, and a peristaltic pump may be provided for regulating the pressure as described below.

Figure 1:
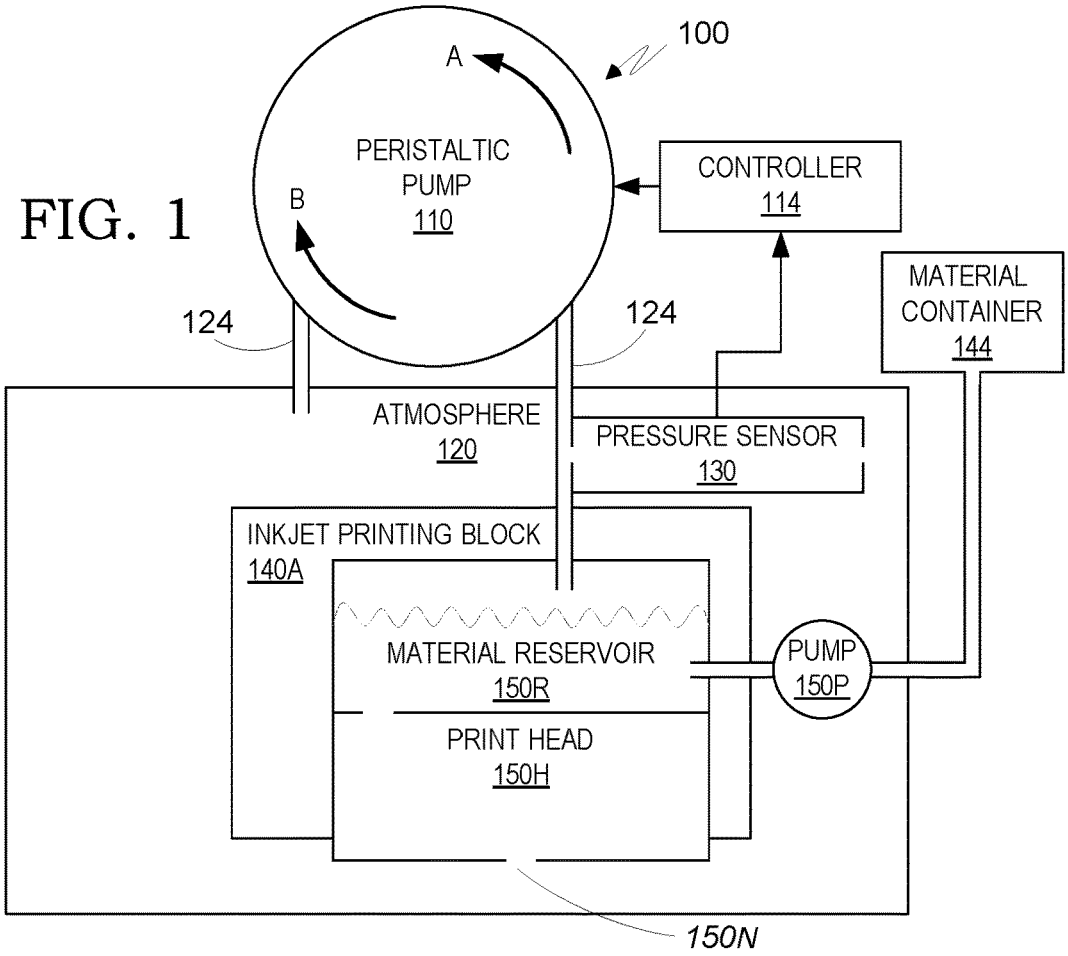
FIG. 1 illustrates a schematic diagram of an apparatus for maintaining predetermined sub-atmospheric pressure within a reservoir supplying material to a printing head according to a preferred embodiment of the present invention.

Reference is made to FIG. 1 which illustrates a schematic diagram of an apparatus 100 for maintaining predetermined sub-atmospheric pressure of the air above the liquid level in a reservoir supplying material to a printing head according to a preferred embodiment of the present invention.

An inkjet printing block 140A may include material reservoir 150R for retaining a liquid material, such as ink, wax and/or a curable polymer (e.g. in printers for printing three-dimensional objects, such as, for example, described in U.S. Pat. Nos. 7,658,976, 7,725,209, 7,991,498, all incorporated herein by reference) and a print head 150H that includes one or more print nozzles 150N for dispensing the material.

Material reservoir 150R may be designed to supply liquid material to print head 150H as needed, to compensate for, i.e. replace quantities of material dispensed via the print nozzles 150N. The wavy line within material reservoir 150R symbolically represents separation between the material (below the line) and air (above the line), i.e. the liquid level within the reservoir. To prevent gravitational leakage from print nozzles 150N, a certain vacuum level relative to the surrounding atmosphere 120, for example −60 mm water pressure, may be continually maintained within material reservoir 150R. In practice, the mechanisms for the maintenance of the pressure difference may afford a tolerance of for example ±5%. In another example, the mechanisms for the maintenance of the pressure difference may afford a tolerance of ±5 mm water pressure.

In order to maintain the required vacuum level, a peristaltic pump 110 may be placed between material reservoir 150R and atmosphere 120, the peristaltic pump located along duct 124 connecting material reservoir 150R with atmosphere 120. When peristaltic pump 110 revolves in the direction indicated by A (counter-clockwise, in this example), it moves air from material reservoir 150R of inkjet printing block 140A to atmosphere 120, thereby increasing the vacuum within material reservoir 150R. Similarly, revolving peristaltic pump 110 in the opposite (B) direction (that is clockwise, in this example) moves air from atmosphere 120 into material reservoir 150R, thereby increasing the pressure within material reservoir 150R, i.e. reducing the vacuum there.

There are five mechanisms that regulate the current pressure above the material level in the material reservoir 150R (see also blocks 209-225 in FIG. 2): (i) Pump 150P may add material from material container 144, thereby reducing the vacuum within the material reservoir; (ii) Print nozzle(s) 150N dispenses material during printing, thereby increasing vacuum within the material reservoir 150R; and Peristaltic pump 110 may controllably: (iii) increase the vacuum (revolving in direction A), (iv) decrease the vacuum (revolving in direction B) or (v) remain still, to maintain the current pressure within the material reservoir 150R, virtually acting as a closed valve.

Controller 114 receives a current pressure data from pressure sensor 130, which represents the pressure difference between the atmospheric pressure and the pressure within pipe 124, which, in turn, corresponds to the pressure above the liquid material level within material reservoir 150R, and actuates peristaltic pump 110 to revolve as necessary to maintain a predetermined level of vacuum within material reservoir 150R. If the current pressure is sufficiently close to the predetermined level, then controller 114 keeps peristaltic pump 110 still, actually functioning as a closed valve.

Figure 1A:
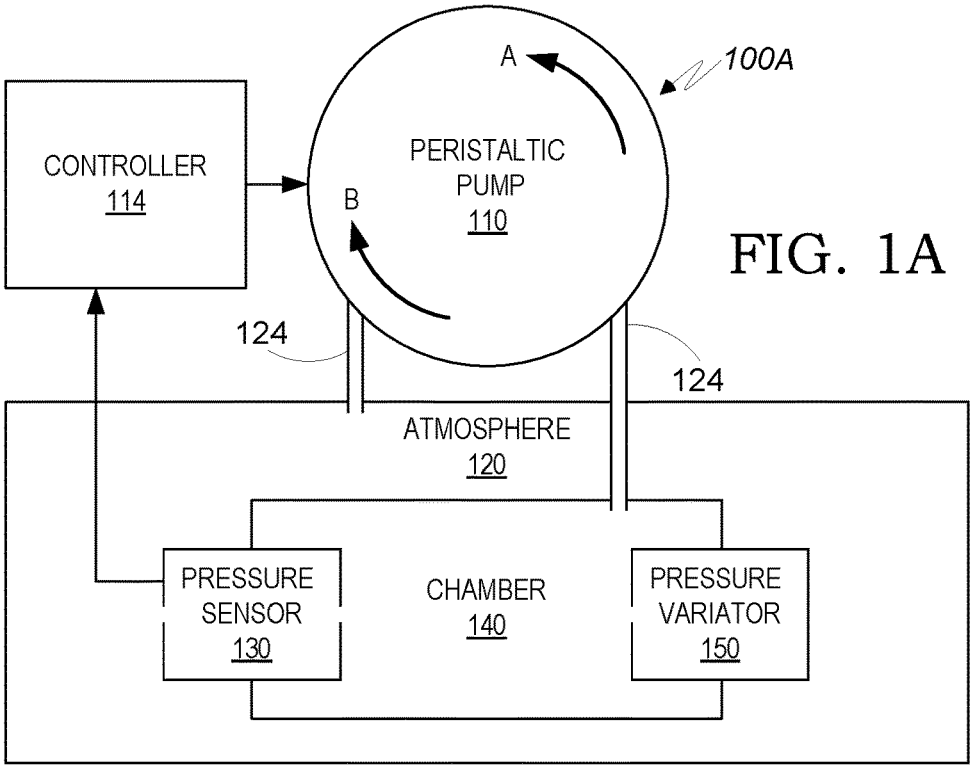
FIG. 1A illustrates a schematic diagram of an apparatus for maintaining predetermined sub-atmospheric pressure within a chamber according to a preferred embodiment of the present invention.

Reference is now made to FIG. 1A, illustrating a schematic diagram of an apparatus 100A for maintaining predetermined sub-atmospheric pressure within a chamber according to a preferred embodiment of the present invention, generalizing the inventive concept described above to a more general case of maintaining a specified air pressure within a chamber, which can be positive or negative within the operative range of peristaltic pumps.

Thus, apparatus 100A includes chamber 140 in which it is desired to maintain a predetermined pressure level. Pressure variator 150 may be any device or combination of devices that may add air or another material into chamber 140 and may remove air or another material from chamber 140. To prevent or compensate for pressure fluctuations within chamber 140 caused by operation of pressure variator 150, peristaltic pump 110 may be placed between chamber 140 and atmosphere 120, and operate under the control of controller 114. Pressure sensor 130 may be used to measure the pressure difference between the inside of chamber 140 and the outside atmosphere 120, and controller 114 may actuate peristaltic pump 110 so as to maintain a predetermined pressure within chamber 140, in a manner similar to the manner described hereinabove with reference to FIG. 1. Similarly as described with relation to FIG. 1, five mechanisms play a role in maintaining the pressure in chamber 140: (i) addition of air or another material into chamber 140 by a device being part of Pressure variator 150; (ii) removal of air or material from chamber 140 by a device being part of Pressure variator 150; and peristaltic pump 110 may controllably: (iii) increase the vacuum (revolving in direction A), (iv) decrease the vacuum (revolving in direction B) or (v) remain still, to maintain the current pressure within chamber 140.

Figure 2:
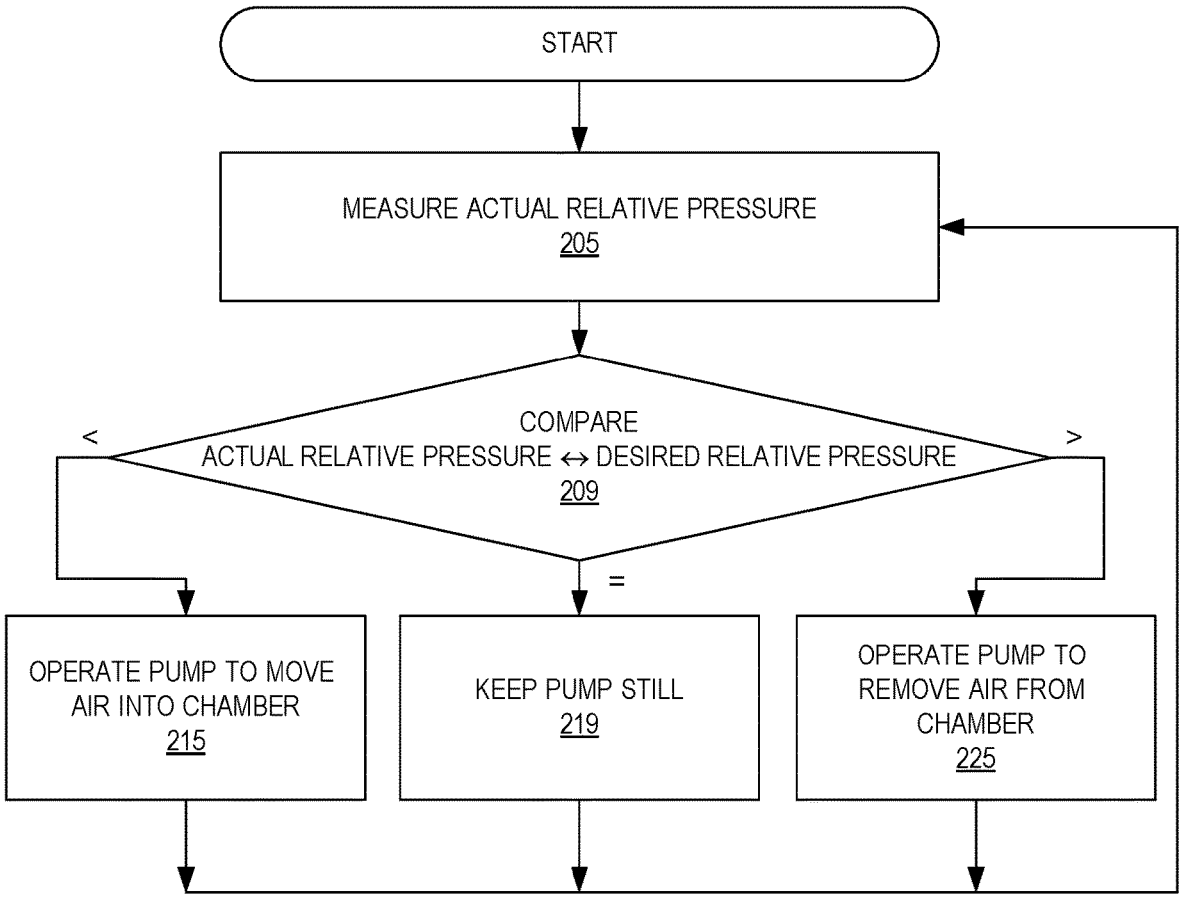
FIG. 2 is a flow chart illustrating a method for maintaining a predetermined pressure within a chamber, according to embodiments of the present invention.

FIG. 2 is a flowchart describing the operation of an apparatus for maintaining a predetermined pressure within a chamber, in accordance with embodiments of the present invention. The apparatus includes a peristaltic pump located along a duct connecting the inside of the chamber to the outside ambient atmosphere (see, for example FIG. 1 and FIG. 1A). The method may include measuring 205 the actual relative pressure of the chamber (that is, the pressure difference between the pressure within the chamber and a reference ambient pressure of atmosphere 120, i.e. a "reference space").

The relative pressure may be measured by a pressure sensor and reported to a controller. The method may further include comparing 209 the pressure difference between the actual relative pressure and a desired relative pressure or pressure range. The comparison may be carried out, for example, by a controller that receives pressure measurements from a pressure sensor. If the measured relative pressure, i.e. actual relative pressure is lower than the desired relative pressure, or a desired pressure difference range, the peristaltic pump may be operated 215 to add air to the chamber, thereby increasing the actual relative pressure (reducing the vacuum) toward the desired level. If the measured actual relative pressure is higher than the desired relative pressure, or a desired pressure difference range, then the peristaltic pump may be operated 225 to remove air from the chamber, thereby reducing the actual relative pressure (increasing the vacuum) within the chamber toward the desired level. If the measured actual relative pressure is found to be equal or sufficiently close (within a predetermined pressure difference range) to the desired relative pressure, then the peristaltic pump is kept 219 still, thereby effectively causing the peristaltic pump to act as a valve that blocks passage of air between the ambient atmosphere and the inside of the chamber.

The pressure difference range may be a modifiable parameter of the apparatus, so as to allow setting it by a user, thereby affecting the sensibility of the apparatus to changes in the pressure difference.

Examples of determination of desired pressure levels:

EXAMPLE 1

Liquid level above nozzle level=50-60 mm; Gravity of liquid material=1; the desired relative pressure: about −60 mm water pressure

EXAMPLE 2

Liquid level above nozzle level:=50-60 mm; Gravity of liquid material=3; the desired relative pressure: about −60 mm water pressure While the invention has been described with respect to a limited number of embodiments, it will be appreciated by persons skilled in the art that the present invention is not limited by what has been particularly shown and described herein. Rather the scope of the present invention includes both combinations and sub-combinations of the various features described herein, as well as variations and modifications which would occur to persons skilled in the art upon reading the specification and which are not in the prior art.

The invention claimed is:

1. A system for pressure regulation of an inkjet printing system comprising:

an inkjet printing block comprising an inkjet printing head having one or more nozzles and a material reservoir configured to contain a liquid material to be dispensed by the one or more nozzles of the printing head;

a pressure sensor configured to monitor an actual pressure difference between an air pressure of air contained within the material reservoir above the liquid material and a reference pressure at the ambient atmosphere;

a peristaltic pump for maintaining a specified air pressure within the material reservoir above the liquid material, which peristaltic pump can rotate in a first direction to increase the air pressure in the material reservoir and rotate in a second direction to increase the vacuum in the material reservoir, wherein the peristaltic pump is located along a duct connected at one end to a space above the liquid material in the material reservoir and at the other end to a source of air from the ambient atmosphere, and is configured to (i) move air from the ambient atmosphere into the material reservoir; (ii) remove air from the material reservoir toward the ambient atmosphere; or (iii) remain still and function as a closed valve, based on a signal received from the pressure sensor so as to maintain the specified air pressure;

a controller coupled to the pressure sensor and the peristaltic pump and configured to receive a signal from the pressure sensor, to determine the actual pressure difference and to operate the peristaltic pump; wherein the controller is configured to cause the peristaltic pump to operate when the determined pressure difference exceeds a predetermined pressure difference range, and wherein the predetermined pressure difference range is a modifiable parameter of the system.

2. A method for maintaining a specified positive or negative air pressure in a material reservoir of an inkjet printing head, the method comprising:

monitoring an air pressure of air contained within the material reservoir above a liquid material level relative to a reference pressure at ambient atmosphere by determining an actual pressure difference between the air pressure within the material reservoir and the reference pressure, based on a measurement received from a pressure sensor;

adding liquid material, by a liquid pump, from a material container into the material reservoir; and operating a peristaltic pump located along a duct connected at one end to a space above the liquid material in the material reservoir and at the other end to a source of air in the ambient atmosphere and causing the peristaltic pump to (i) move air from the ambient atmosphere into the material reservoir; (ii) remove air from the material reservoir toward the ambient atmosphere; or (iii) remain still and function as a closed valve, based on the amount of liquid material in the material reservoir and the determined actual pressure difference so as to maintain the actual pressure difference within predetermined proximity to a desired pressure difference, and wherein the desired pressure difference range is a modifiable parameter of the system.

3. The method of claim 2, further comprising causing the peristaltic pump to operate when the measured pressure difference exceeds the predetermined pressure difference range.

4. The method of claim 2, further comprising modifying the predetermined pressure difference range.

* * * * *